US005647542A

United States Patent [19]

Diana

[11] Patent Number: 5,647,542

[45] Date of Patent: Jul. 15, 1997

[54] SYSTEM FOR ELECTROSTATIC APPLICATION OF CONDUCTIVE COATING LIQUID

[75] Inventor: Michael J. Diana, West Dundee, Ill.

[73] Assignee: Binks Manufacturing Company, Franklin Park, Ill.

[21] Appl. No.: 377,426

[22] Filed: Jan. 24, 1995

[51] Int. Cl.[6] ..... B05B 5/025

[52] U.S. Cl. ..... 239/690; 239/695; 239/112; 239/124; 118/688

[58] Field of Search ..... 239/690, 695, 239/112, 123, 124, 74, 708; 222/64; 118/688, 697; 137/566

[56] References Cited

U.S. PATENT DOCUMENTS

| | | | |
|---|---|---|---|
| 3,933,285 | 1/1976 | Wiggins | 222/56 |
| 3,937,400 | 2/1976 | Krause | 239/11 |
| 4,017,029 | 4/1977 | Walberg | 239/15 |
| 4,085,892 | 4/1978 | Dalton | 239/15 |
| 4,275,834 | 6/1981 | Spanjersberg et al. | 239/3 |
| 4,313,475 | 2/1982 | Wiggins | 141/18 |
| 4,375,865 | 3/1983 | Springer | 239/112 |
| 4,629,119 | 12/1986 | Plunkett | 239/63 |
| 4,771,729 | 9/1988 | Planert et al. | 118/697 |
| 4,792,092 | 12/1988 | Elberson et al. | 239/3 |
| 4,878,622 | 11/1989 | Jamison et al. | 239/690.1 |
| 4,879,137 | 11/1989 | Behr et al. | 427/27 |
| 4,881,688 | 11/1989 | Hankvist et al. | 239/691 |
| 4,884,745 | 12/1989 | Spongh | 239/3 |
| 4,932,589 | 6/1990 | Diana | 237/3 |
| 4,962,724 | 10/1990 | Prus et al. | 118/688 |
| 4,982,903 | 1/1991 | Jamison et al. | 239/690.1 |
| 4,993,644 | 2/1991 | Klemm | 239/690 |
| 5,033,942 | 7/1991 | Petersen | 417/477 |
| 5,078,168 | 1/1992 | Konieczynski | 137/566 |
| 5,090,594 | 2/1992 | Randall, Jr. et al. | 222/64 |
| 5,094,389 | 3/1992 | Giroux et al. | 239/690 |
| 5,096,126 | 3/1992 | Giroux et al. | 239/690 |
| 5,102,045 | 4/1992 | Diana | 239/3 |
| 5,102,046 | 4/1992 | Diana | 239/3 |
| 5,152,466 | 10/1992 | Matushita et al. | 239/690 |
| 5,154,357 | 10/1992 | Jamison et al. | 239/690 |
| 5,193,750 | 3/1993 | LaMontagne et al. | 239/708 |
| 5,196,067 | 3/1993 | Lacchia | 118/694 |
| 5,197,676 | 3/1993 | Konieczynski et al. | 239/690 |
| 5,221,194 | 6/1993 | Konieczynski et al. | 239/708 |
| 5,249,748 | 10/1993 | Lacchia et al. | 239/690 |
| 5,271,569 | 12/1993 | Konieczynski et al. | 239/690 |
| 5,288,029 | 2/1994 | Ishibashi et al. | 239/690 |
| 5,288,525 | 2/1994 | Diana | 239/112 |
| 5,326,031 | 7/1994 | Konieczynski | 239/3 |
| 5,328,093 | 7/1994 | Feitel | 239/3 |
| 5,340,289 | 8/1994 | Konieczynski et al. | 417/430 |
| 5,341,990 | 8/1994 | Konieczynski et al. | 239/3 |
| 5,364,035 | 11/1994 | Ma et al. | 239/690 |

*Primary Examiner*—Andres Kashnikow
*Assistant Examiner*—Lisa Ann Douglas
*Attorney, Agent, or Firm*—Wallenstein & Wagner, Ltd.

[57] ABSTRACT

A system for electrostatic application of conductive coating liquid has a grounded primary supply of conductive coating liquid, an electrostatic spray device and a system for delivering coating liquid from the primary supply to the spray device while maintaining a high voltage at the spray device electrically isolated from the primary supply. The delivery system includes one or more electrical insulation devices, each of which has a cylinder comprising an insulative conduit having a liquid inlet and a liquid outlet. The cylinders of the electrical insulation devices are connected via their inlets and outlets between the primary supply and the spray device to deliver coating liquid from the primary supply to the spray device. Each electrical insulation device has within its cylinder a piston that is movable between the inlet to and the outlet from the cylinder to move coating liquid out of the cylinder while scraping the inside wall of the cylinder free of coating liquid, so that the cylinder becomes substantially electrically insulating between its inlet and outlet.

23 Claims, 3 Drawing Sheets

FIG. I

SYSTEM FOR ELECTROSTATIC APPLICATION OF CONDUCTIVE COATING LIQUID

BACKGROUND OF THE INVENTION

The present invention relates system for supplying coating liquid to spray coating apparatus, and in particular to systems for supplying conductive coating liquid to electrostatic spray coating apparatus.

Systems for supplying coating liquid to spray coating apparatus often embody a color changer, particularly in industrial operations where articles are to be spray coated at a station or as they move along a production line. Where the articles are to be coated a wide variety of colon, it generally is not practical to establish separate spray stations or production lines for each color, or even to spray a long sequence of articles one color, then another long sequence of articles a second color, etc. Instead, it is desirable to make color changes rapidly and simply at a single station.

Electrostatic spray coating provides for increased coating efficiency over nonelectrostatic spray coating. In order to charge the coating liquid, in some systems an electrode is connected to a high voltage supply and placed in close proximity to or in contact with the coating liquid either just prior to or very close to the point of atomization of the coating liquid. In rotary atomization systems, the rotary atomizer may be conductive and connected to the power supply, so that the atomizer is the electrode. The charging voltage connected to the electrode is usually on the order of several tens of kilovolts, which does not present a problem in maintaining a grounded primary supply of coating liquid when spraying nonconductive coating liquid. However, when spraying coating liquids that are moderately conductive, precautions must be taken to prevent the high voltage at the spray device from short circuiting to ground through a conductive column of coating liquid leading back to a grounded primary supply.

One early approach to prevent shorting out the high voltage was to not ground the primary supply of coating liquid, but instead to isolate the entire primary supply and any color change system from ground potential. This allowed the entire coating liquid system to "float" at the charging potential, but had the drawback that a large mount of electrical energy was capacitively stored in the system. To prevent the capacitively stored energy from presenting a shock hazard to operating personnel, it was necessary to provide a protective enclosure around the mating liquid system, which increased the cost of the system and required that the spraying operation be shut down and the system electrically discharged whenever necessary to replenish the supplies of coating liquid. Also, during operation of the system, the capacitively stored energy gave rise to the possibility of a spark causing an explosion in an environment such as exists when solvent based paints are being sprayed.

Another prior approach was to ground the primary supply of coating liquid and any color changer, and connect the spraying apparatus to the primary supply through a hose that was long enough that the electrical resistance of the coating liquid in the hose, between the high voltage at the spray device and the coating liquid primary supply, was large enough to reduce electrical current leakage to a level that did not short out the electrode or cause the charging voltage to fall to an unacceptable level. A disadvantage of the approach was that the hose, due to its extended length, not only was very bulky and hard to manage, but also it was difficult to flush the hose clean of one color of coating liquid in preparation for spraying another color. Further, although the extended length of the hose decreased the magnitude of leakage current, leakage current nonetheless occurred and represented "wasted" charging energy.

Another known and more recent technique involves the use of an intermediate storage tank of relatively small capacity that is electrically insulated from ground, at least during spraying, and is adapted to be intermittently supplied with coating liquid for delivery to the spray device. A switchable high voltage source is provided, together with means for separating or at least electrically insulating the intermediate storage tank during electrostatic spraying from parts of the system that are permanently grounded.

OBJECT OF THE INVENTION

The primary object of the present invention is to provide improved systems for delivering coating liquid to an electrostatic spray coating device, which electrically isolate a grounded primary supply of the coating liquid from an electrostatic charging voltage at the spray device, so that even when the coating liquid is conductive there is no substantial leakage of charging current to the primary supply.

SUMMARY OF THE INVENTION

In accordance with the present invention, a system for electrostatic application of relatively conductive coating liquid comprises an electrostatic spray device coupled to an interruptable high voltage supply; reservoir means coupled to the spray device to supply the spray device with coating liquid; a grounded coating liquid supply means; and means for transferring coating liquid from the coating liquid supply means to the reservoir means while maintaining electrical isolation therebetween. The transferring means comprises at least three isolator means of electrically insulating material, each of which includes passage means extending between an inlet to and an outlet from the passage means, together with means for displacing from the passage means and through the outlet coating liquid introduced to the passage means through the inlet. Each isolator means is electrically insulating between its inlet and outlet upon displacement of coating liquid from its passage means, and the at least three isolator means are connected with their passage means in series between the coating liquid supply means and the reservoir means to define a flow path for transfer of coating liquid from the coating liquid supply means to the reservoir means. To maintain electrical isolation of the reservoir means from the grounded coating liquid supply means, means for operating the displacing means operate the same so that coating liquid is displaced from the passage means of at least one of the isolator means at all times when the high voltage is present, whereby electrical isolation is always maintained between the reservoir means and the grounded coating liquid supply means, and thereby between the high voltage and the grounded coating liquid supply means when the high voltage is present.

The invention contemplates placing two electrostatic application systems in parallel to supply coating liquid to a spray device, such that while one application system is supplying coating liquid the other is being cleaned of coating liquid previously supplied, to decrease the time required to change the color of coating liquid delivered to the spray device. In this case, the apparatus for electrostatic application of relatively conductive coating liquid comprises first and second application systems, each said application system including a grounded coating liquid supply means, reservoir means, and means for transferring coating liquid from the coating liquid supply means to the reservoir means while electrostatic application of coating liquid is occurring and while maintaining electrical isolation between the reservoir means and the coating liquid supply means. The apparatus also has an electrostatic spray device coupled to an interruptable high voltage supply; first isolator means coupled between the first application system reservoir means and the spray device and operable between a first state establishing a coating liquid flow path from the reservoir means to the spray device and a second state interrupting the flow path and electrically isolating the reservoir means from a high voltage at the spray device. Additionally, second isolator means is coupled between the second application system reservoir means and the spray device and is operable between a first state establishing a coating liquid flow path from the reservoir means to the spray device and a second state interrupting the flow path and electrically isolating the reservoir means from a high voltage at the spray device.

In accordance with a further embodiment of the invention, a system for electrostatic application of relatively conductive coating liquid comprises an electrostatic sprayer coupled to an interruptable high voltage supply; grounded coating liquid supply means; and reservoir means. A first isolator means having passage means is coupled with its passage means in series with a first coating liquid flow path between the coating liquid supply means and the reservoir means and is operable between a first state establishing a path through the passage means and a second state interrupting the path through the passage means and providing electrical isolation in the first flow path between the coating liquid supply means and the reservoir means. A second isolator means having passage means is coupled with its passage means in series with a second coating liquid flow path between the reservoir means and the spray device and is operable between a first state establishing a path through its passage means and a second state interrupting the path through its passage means and providing electrical isolation in the second flow path between the reservoir means and the spray device.

The foregoing and other objects, advantages and features of the invention will become apparent upon a consideration of the following detailed description, when taken in conjunction with the accompanying drawings.

DETAILED DESCRIPTION

Figure 1:
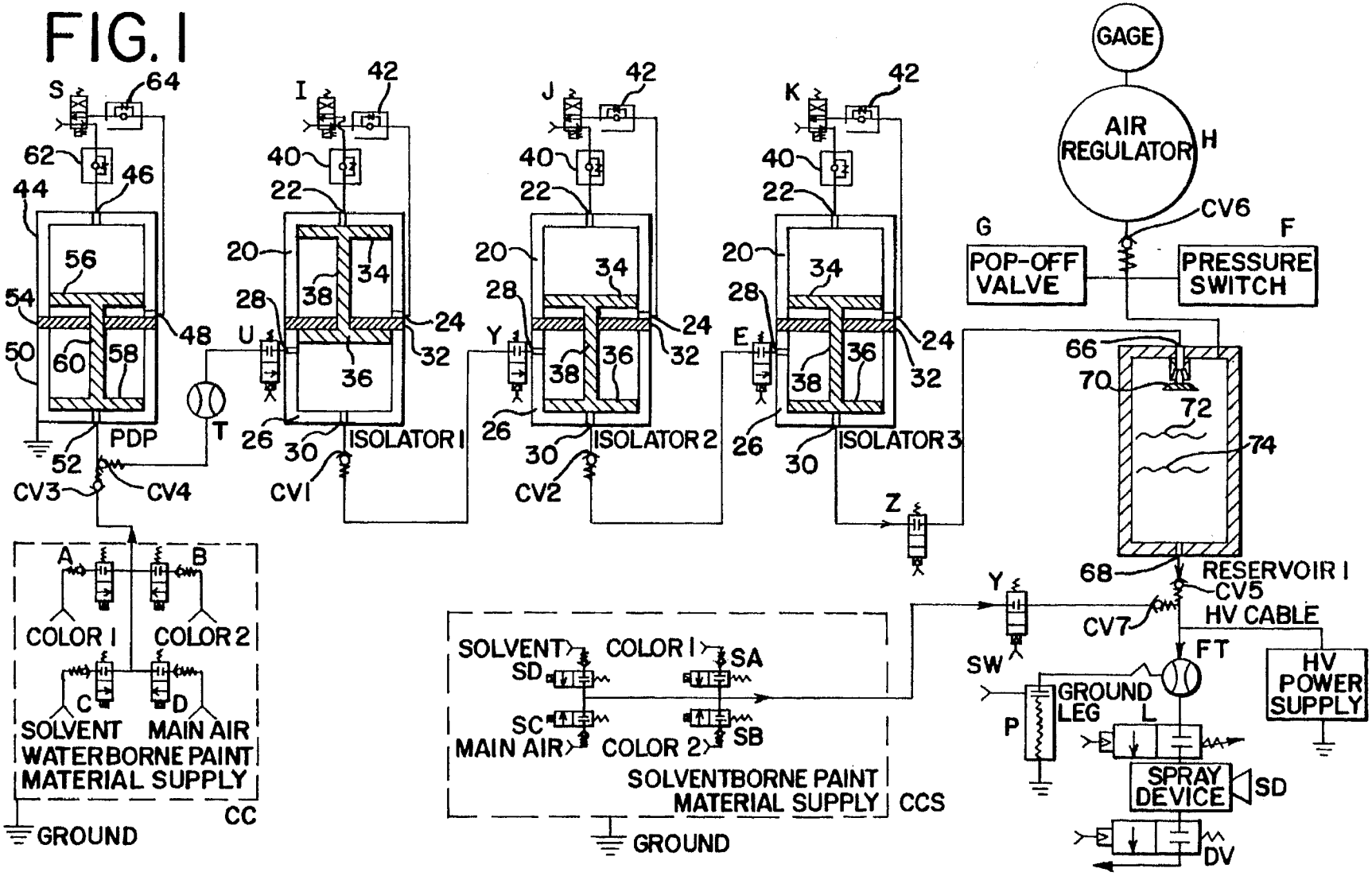
FIG. 1 is a schematic representation of a system for delivering coating liquid to an electrostatic spray coating device, in accordance with one embodiment of the invention.

FIG. 1 schematically shows a system for electrostatic application of conductive coating liquid, which system has a grounded primary supply of conductive coating liquid, an electrostatic applicator for emitting coating liquid, and a delivery system between the primary supply and the electrostatic applicator for delivering coating liquid from the primary supply to the applicator while maintaining electrical isolation between a high electrostatic charging voltage at the applicator and the grounded primary supply.

More particularly, the electrostatic application system has a high voltage electrostatic coating applicator, such as a spray gun or spray device SD, adapted to be supplied with and to emit in an electrostatically charged atomized spray any one of a plurality of coating liquids, such as any one of a plurality of different colors of liquid paint. The spray device is conventional and can have mating liquid delivered to it through a fiberoptic flow meter FT and a regulator valve L. Where the coating liquid is electrically conductive, a high voltage power supply can have its output coupled to the paint, for example upstream from the fiberoptic flowmeter FT for connection of the high voltage to the spray device through the paint. Alternatively, the output from the power supply can be connected directly to the spray device. For safety, a ground leg P is selectively actuable to close a switch SW to connect to ground and discharge the high voltage side of the system, and a dump valve DV between a flush outlet from the spray device and a dump tank accommodates flushing the system and spray device of one color of paint in preparation for spraying another color.

The application system also includes a color changer CC for selectively supplying any one of a number of different colors of paint or coating material to the spray device SD, of which color 1 and color 2 represent two of a large number of different colors. The colors 1 and 2 of paint are selectively connectable to an outlet from the color changer through respective valves A and B, and air under pressure and solvent can also be supplied at the color changer outlet through respective valves C and D. Although the coating materials may be electrically nonconductive, the application system is uniquely adapted to supply conductive coating materials to the spray device while maintaining electrical isolation between the color changer and the high voltage at the spray device. In essence, the structure and mode of operation of the system prevents the high voltage at the spray device from ever being coupled to the color changer through a column of conductive coating material extending between the spray device and the color changer. The color changer can therefore be and is grounded for safety, since by virtue of the high voltage at the spray device being isolated from the color changer, grounding the color changer does not short out the high voltage or result in excess leakage current to the color changer.

Intermediate the primary supply of coating material and the electrostatic spray device SD is a delivery means for conveying coating liquid from the color changer to the spray device while maintaining electrical isolation between the high electrostatic charging voltage at the spray device and the grounded color changer and its paint supplies. The delivery means includes electrical insulation devices comprising isolators 1, 2 and 3 connected in series between the color changer and spray device and constructed and operated in a manner to deliver paint from the color changer to the spray device while maintaining electrical isolation therebetween. The isolators 1, 2 and 3 may be identical and each is made of electrically insulating material and includes an air cylinder 20 having an air inlet/outlet 22 at one end and an air inlet/outlet 24 at an opposite end. Each also includes a liquid cylinder 26 having a liquid inlet 28 toward one end and a liquid outlet 30 at an opposite end. The cylinders 20 and 26 mount on opposite sides of a divider 32 and contain a piston assembly comprising an air piston 34, a liquid piston 36 and a rod 38 connecting the pistons. The air piston is slidable within the air cylinder, the liquid piston is slidable within the liquid cylinder and the rod is slidable in a passage through the divider. The piston assembly is movable between an upper position as shown in isolator 1, where the liquid piston 36 is above the liquid inlet 28, and a lower position as shown in isolator 2. As will be described, paint delivered to the spray device passes through the liquid cylinders 26 of the isolators, and when the piston assembly of an isolator is moved downwardly, the liquid piston scrapes the inside wall of the liquid cylinder clean of paint, so that when the piston assembly is in its lower position the liquid cylinder, which serves as an insulative conduit for paint, is electrically insulating between its liquid inlet 28 and its liquid outlet 30.

To move the piston assemblies of the isolators at controlled speeds between their upper and lower positions, associated with the isolators 1, 2 and 3 are respective valves I, J and K. One port of each valve connects through a speed control valve 40 to the air inlet/outlet 22 of its isolator and another port of each valve connects through a speed control valve 42 to the air inlet/outlet 24 of its isolator. Each valve I, J and K is selectively operable to deliver air under pressure to one air inlet/outlet while venting the other air inlet/outlet to move the piston assembly of its associated isolator between upper and lower positions.

The isolators 1, 2 and 3 have at their liquid inlets 28 associated inlet valves U, Y and E that are operable to establish or interrupt liquid flow paths through the liquid inlets into the liquid cylinders 26 of the isolators. The liquid cylinders are connected in series to provide a selectively interruptable liquid flow path from the inlet valve U of the isolator 1 to the liquid outlet 30 of the isolator 3. This is accomplished by connecting the liquid outlet 30 of the isolator 1 through a check valve CV1 to the inlet valve Y of the isolator 2, and by connecting the liquid outlet 30 of the isolator 2 through a check valve CV2 to the inlet valve E of the isolator 3. As connected, the isolators 1, 2 and 3 are operable in a manner to deliver mating liquid from the color changer CC to the spray device SD while maintaining isolation between the high voltage at the spray device and the grounded color changer.

To supply paint from the color changer CC to the isolators, the outlet from the color changer connects to the liquid inlet 28 to the isolator 1 through two check valves CV3 and CV4, a flow meter T and the inlet valve U to deliver to the isolator a metered amount of a selected color of paint. In addition, paint can also be supplied from the color changer to the isolator 1 by way of a positive displacement pump PDP, which comprises an air cylinder 44 having an upper air inlet/outlet 46 and a lower air inlet/outlet 48, a liquid cylinder 50 having a liquid inlet/outlet 52, a divider 54 mounting on its opposite sides the air and liquid cylinders, and a piston assembly comprising an air piston 56 in the air cylinder, a liquid piston 58 in the liquid cylinder and a rod 60 extending through an opening in the divider and between the air and liquid pistons. The pump is made of electrically conductive material and connected to ground potential and has a valve S that is operable to apply air under pressure to either the air inlet/outlet 46 through a speed control valve 62 or to the air inlet/outer 48 through a speed control valve 64, while simultaneously venting the other air inlet/outlet. Air under pressure at the air inlet/outlet 46 moves the piston assembly downward to a lower position as shown, while air under pressure at the air inlet/outlet 48 moves the piston assembly to an upper position. In use of the pump to deliver paint, the piston assembly is moved upwardly while a selected color of paint is flowed from the color changer outlet through the check valve CV3 and the liquid inlet/outlet 52 into the liquid cylinder 50. The paint is then moved from the pump into the isolator 1 by driving the pump piston assembly downwardly while simultaneously opening the inlet valve U to flow paint from the pump liquid inlet/outlet 52 and through the check valve CV4, the flow meter T and the valve U into the liquid cylinder 26 of the isolator 1. During delivery of paint to the isolator 1, whether directly from the color changer CC or via the positive displacement pump PDP, the flow meter T meters the amount of paint introduced to the isolator 1. To facilitate introducing paint into the liquid cylinder of the isolator 1, when the piston assembly of the isolator 1 was moved to its upper position a partial vacuum was dram within the liquid cylinder.

From the outlet from the delivery system at the liquid outlet 30 of the isolator 3, paint is delivered through a valve Z to an inlet 66 to a reservoir 1. An outlet 68 from the reservoir connects through a check valve CV5, the fiberoptic flow meter FT and the regulator valve L to the spray device SD. A deflector 70 at the inlet to the reservoir deflects incoming paint outwardly in a conical sheet to cylindrical sidewalls of the reservoir to decrease aeration of the paint introduced into the reservoir. When the reservoir is empty its interior is pressurized at a selected minimum air pressure, for example about 25 psi, by an air regulator H operating through a check valve CV6. The pressure inside the reservoir is sensed by a pressure limit switch F that is adjustable to sense a high pressure limit such as 40 psi and a low pressure limit such as 32 psi, and a pop-off valve G prevents the pressure in the reservoir from exceeding a selected maximum value such as 80 psi. The upper pressure limit is sensed when paint introduced into the reservoir reaches a high paint level 72 and the lower pressure limit is sensed when the paint level in the reservoir falls to a low level 74.

FIG. 1 shows the application system clean and empty of paint. To prepare the system to deliver paint to the spray device SD, the air regulator It is set to pressurize the reservoir 1 at a selected pressure, such as 25 psi, and the pressure limit switch F is set at upper and lower limits, for example 40 psi and 32 psi, corresponding to the pressures that exist in the reservoir at respective high and low reservoir paint levels 72 and 74. The system is then ready to be loaded with paint either via the flow meter T alone or via both the positive displacement pump PDP and the flow meter. The flow meter can, as desired, either replace or be used in addition to the pump.

To load a selected color of paint into the delivery system and to deliver the paint to the spray device, the application system is operated as follows:

Step 1: Beginning with an empty system, the various piston assemblies are moved to the positions shown in FIG. 1, such that the piston assemblies of the positive displacement pump PDP and of the isolators 2 and 3 are lowered and the piston assembly of the isolator 1 is raised. The piston assembly of the isolator 1 is raised while the valve U is closed, which causes a vacuum to be drawn in the liquid cylinder 26 of the isolator. At this point, loading the application system with paint from the color changer CC can take place either by using the flow meter T alone or by using both the flow meter T and the pump PDP.

Step 1A: To load paint of color 1 into the application system using the flow meter T but not the positive displacement pump PDP, the valve A of the color changer CC and the inlet valve U are opened to flow paint from the color changer outlet through the check valves CV3 and CV4, the flow meter T, the inlet valve U and the liquid inlet 28 to the isolator 1 into the liquid cylinder 26 of the isolator until the flow meter reaches a set limit on the mount of paint, whereupon the valves A and U are closed. During filling of the liquid cylinder of the isolator 1, the valve I is operated while the valve Y is closed to introduce air under pressure through the speed control valve 42 and the air inlet/outlet 24 of the isolator 2, while venting the air inlet/outlet 22 of the isolator through the speed control valve 40, to raise the piston assembly of the isolator 2 at a controlled speed to its upper position. As the piston assembly is raised a vacuum is drawn in the liquid cylinder of the isolator 2.

Step 1B: As an alternative to Step 1A, to load paint of color 1 into the system using both the positive displacement pump PDP and the flow meter T, the color changer valve A is opened and the valve S is operated to raise the piston assembly of the pump so that paint of color 1 flows from the color changer outlet, through the check valve CV3 and the liquid inlet/outlet 52 of the pump into the liquid cylinder 50. After the liquid cylinder is loaded with paint, the color changer valve A is closed, the valve U is opened and the valve S is operated to drive the pump piston assembly downward to flow paint from the liquid cylinder, through the pump liquid inlet/outlet 52, the check valve CV4, the flow meter T, the inlet valve U and the liquid inlet/outlet 28 of the isolator 1 into the liquid cylinder 26 of the isolator until a selected amount of paint is flowed into the liquid cylinder as measured by the flow meter, whereupon the inlet valve U is closed. Simultaneously, while the valve Y is closed the valve J is operated to raise the piston assembly of the isolator 2.

Step 2: With the liquid cylinder 26 of the isolator 1 filled with the preselected volume of paint of color 1, the paint is then transferred from the isolator 1 to the isolator 2. The piston assembly of the isolator 2 was raised in step 1, so transfer of paint is accomplished by opening the inlet valve Y and operating the valve I to drive the isolator 1 piston assembly downwardly to move the paint in the liquid cylinder 26 of the isolator 1 through the isolator 1 liquid outlet 30, the check valve CV1, the inlet valve Y and the liquid inlet 28 to the isolator 2 into the liquid cylinder 26 of the isolator 2. As the liquid piston 36 moves downwardly through the liquid cylinder of the isolator 1, in addition to pushing the paint out of the liquid cylinder it also scrapes the paint from the walls of the liquid cylinder, so that when the liquid piston is at its lower position the liquid cylinder of the isolator 1 is substantially electrically insulating between its liquid outlet 30 and its liquid inlet 28. The inlet valve Y is then closed.

Step 3: The paint transferred from the isolator 1 to the isolator 2 is next transferred from the isolator 2 to the isolator 3. This is accomplished by operating the valve K to move the piston assembly of the isolator 3 to its upper position and draw a vacuum in the liquid cylinder 26 of the isolator. The inlet valve E is then opened and the valve J is operated to drive the piston assembly of the isolator 2 to its lower position and push the paint in the liquid chamber 26 of the isolator through the liquid outlet, the check valve CV2, the inlet valve E and the isolator 3 liquid inlet 28 into the liquid cylinder 26 of the isolator 3. As the liquid piston 36 of the isolator 2 moves downwardly it scrapes the paint from the inside walls of its liquid cylinder, so that when it reaches its lower position the liquid cylinder of the isolator 2 is substantially electrically insulating between its liquid outlet 30 and its liquid inlet 28. The inlet valve E is then closed.

Step 4: The paint transferred from the isolator 2 to the isolator 3 is next delivered from the isolator 3 to the reservoir 1. This is accomplished by opening the valve Z while operating the valve K to drive the isolator 3 piston assembly downwardly to force the paint in the liquid cylinder 26 of the isolator 3 through the liquid outlet 30, the valve Z and the reservoir inlet 66 into the reservoir, with the paint upon entering the reservoir being deflected outwardly in a cone by the deflector 70 to decrease entrainment of air in the paint. As the liquid piston 36 moves downwardly it scrapes the walls of the liquid cylinder substantially clean of paint, so that when the piston assembly reaches its lowermost position the liquid cylinder 26 of the isolator 3 is substantially electrically nonconducting between its liquid outlet 30 and its liquid inlet 28. Simultaneously with delivering paint from the isolator 3 to the reservoir, either step 1A or 1B is repeated to reload paint into the isolator 1 and steps 2–4 are then repeated to transfer the paint from the isolator 1 to the reservoir until the reservoir is sufficiently full of paint that air in the reservoir is compressed to the point causing the pressure limit switch F to sense its upper limit, at which is the point the paint in the reservoir is at the high level 72 and further delivery of paint from the color changer CC to the reservoir ceases.

With the reservoir 1 loaded with paint, to spray electrostatically the regulator valve L is operated to deliver paint of color 1 at a selected rate from the reservoir outlet 68 through the check valve CV5, the fiberoptic flow meter FT and the regulator valve to the spray device SD, while a high voltage developed by the power supply is coupled to the spray device through the conductive column of paint to electrostatically charge the spray. When spraying first begins, steps 1A or 1B and 2–3 may be repeated once, if necessary, to load the isolator 3 with paint so that, when the paint level in the reservoir falls to the low level 74 as sensed by the pressure limit switch F, step 4 may be performed. Steps 1A or 1B and 2–4 may then be repeated until the pressure limit switch F again senses its upper set limit when the paint in the reservoir is replenished to its upper level 72.

Steps 1A or 1B and 2–4 are repeated periodically as necessary until it is desired to spray a new color of paint, whereupon a purge sequence is run to clean the application system of paint of color 1 before the next color of paint is loaded and sprayed. So that paint will not be wasted and to facilitate purging the application system, it is desirable that substantially all of the paint of color 1 introduced to the system by the color changer CC be delivered to the spray device SD and sprayed before a purge cycle is initiated. This is accomplished by comparing the amount of paint of color 1 supplied by the color changer, as measured by flow meter T, with the amount of paint of color 1 delivered to the spray device, as measured by the fiberoptic flow meter FT, and controlling performance of steps 1A or 1B and 2–4 so that the amount of paint introduced to the system by the color changer is just slightly greater than the mount of paint delivered to the spray device.

To clean the application system of one color of paint in preparation for loading and spraying another color, the system is operated as follows:

Step 5A: Whether or not the positive displacement pump PDP was used in supplying paint of color 1 to the spray device SD, to clean the system the valves U, Y, E, Z, L and DV are opened, the valve S is operated to raise the piston assembly of the positive displacement pump, the valves I, J and K are operated to raise the piston assemblies of the isolators 1, 2 and 3, and the color changer main air valve C is opened to provide compressed air at the color changer outlet for flow through the application system to push out of the system and through the dump valve to a dump tank most of the paint remaining in the system.

Step 5B: After compressed air has been introduced by the color changer CC to the application system for a selected time, the color changer main air valve C is closed and the color changer solvent valve D is opened to flow solvent through the system to the dump tank. Where the paint is waterborne the solvent can be water, although a more active solvent may be used instead of or following an initial use of water. If the positive displacement pump PDP was previously used and also is to be cleaned, then in performing this step 5B the inlet valve U is alternately closed while the valve S is operated to elevate the piston assembly of the pump to draw solvent into the liquid cylinder 50, following which the valve U is opened and the valve S is operated to move the pump piston assembly downwardly to force the solvent from the liquid cylinder.

Steps 5A and 5B are alternately repeated as necessary to clean the application system, ending with step 5A to flow air through and dry the system. Step 1 is then performed to return the piston assemblies of the pump PDP and the isolators 1, 2 and 3 to their positions shown in FIG. 1. The application system is now ready to be loaded with the next color of paint and to deliver the paint to the spray device SD by performing steps 1A or 1B and 2–4.

To accommodate spraying solventborne paint that is substantially electrically nonconductive, a separate color changer CCS may be provided to selectively supply any one of a number of different colors of solventborne paints to the spray device SD, of which colors 1 and 2 represent two of a large number of different colors. The two colors of paint are selectively supplied at an outlet from the color changer through respective valves SA and SB and air under pressure and solvent can also be supplied through respective valves SC and SD. The outlet from the color changer connects through a valve Y and a check valve CV7 to the inlet to the fiberoptic flow meter FT, bypassing the isolators 1, 2 and 3 and the reservoir 1 since they are not needed to electrically isolate the high voltage at the power supply from the grounded color changer CCS when electrically nonconductive paint is used. It should be noted that for electrically nonconductive paint the output from the power supply is connected to the electrode of the spray device, since the paint cannot be used as a conductor to carry the high voltage to the spray device. Operation of the color changer CCS in delivering a selected color of solventborne paint to the spray device, and in delivering air and solvent to clean the paint flow path between color changes, is conventional and need not be described.

Figure 2:
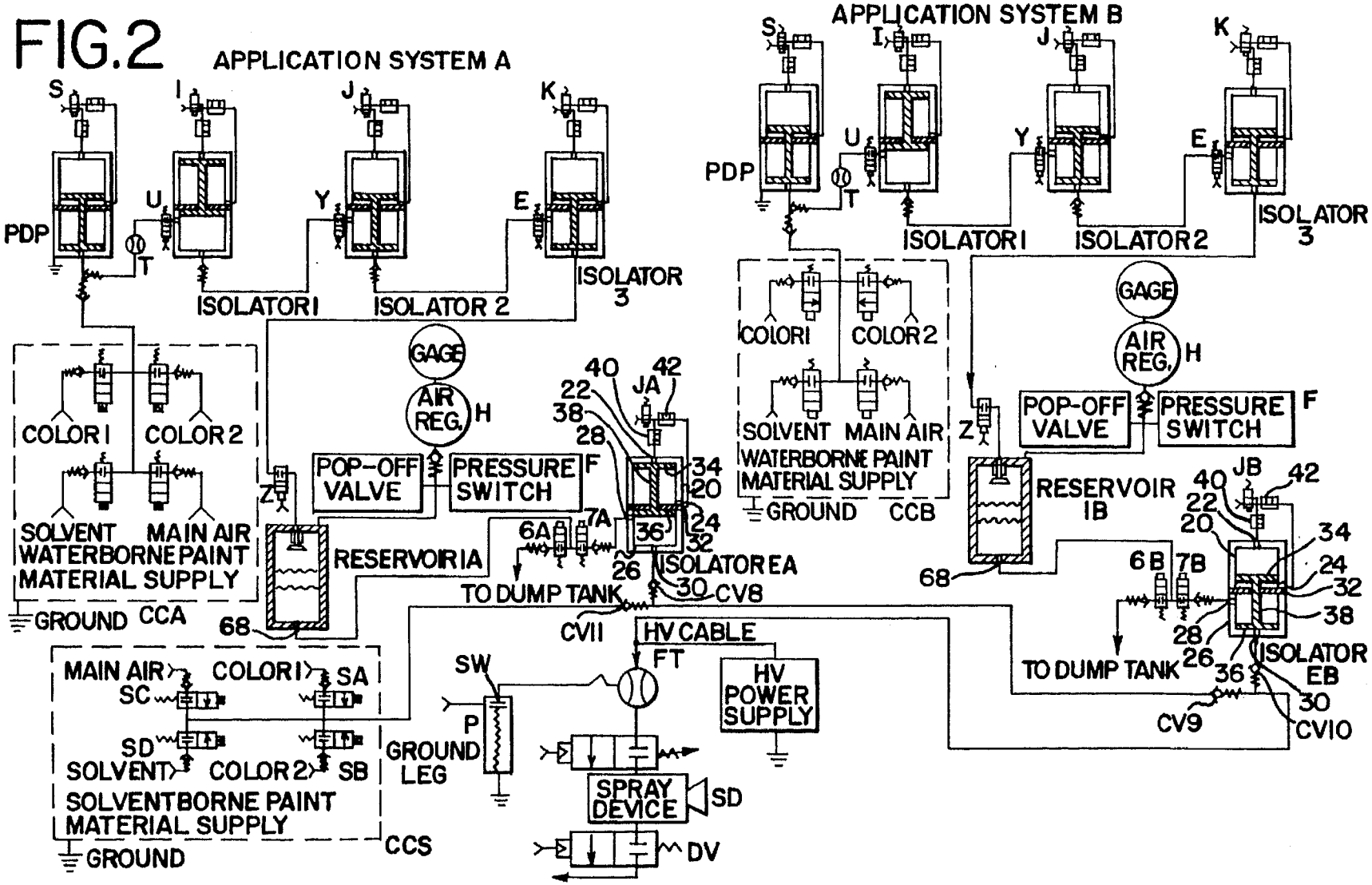
FIG. 2 is a schematic representation of another embodiment of system for delivering coating liquid to an electrostatic spray coating device, which is particularly adapted to accommodate rapid changes in the color of coating liquid delivered to the spray coating device.

FIG. 2 shows an embodiment of the invention in which multiple application systems, for example two application systems A and B, are arranged and operated in such manner that while one application system delivers paint to the spray device SD the other is being flushed to decrease the time required for color changes. It will be understood that more than two application systems could be used, with a greater number enabling even shorter times between color changes, since additional application systems would allow more time for each to be completely cleaned before it is required to again deliver paint. However, the two application systems shown in FIG. 2 are sufficient for the purpose of describing the embodiment of the invention that contemplates using two or more application systems.

The application systems A and B are each identical, from their respective color changers CCA and CCB to their respective reservoirs 1A and 1B, to the application system shown in FIG. 1. Each application system A and B also includes in common, as does the single application system of FIG. 1, a fiberoptic flow meter FT, a ground leg P having a switch SW, a high voltage power supply connected to the fiberoptic flow meter, a regulator valve L between the fiberoptic flow meter and the spray device SD, and a dump valve DV connecting the spray device to a dump tank.

A difference between the application system A and the one of FIG. 1 is that the application system A does not have the outlet 68 from its reservoir 1A connected directly to the fiberoptic flow meter FT. Instead, the reservoir outlet connects to inlets to each of a dump diverter valve 6A and a diverter valve 7A. The valve 6A leads to the dump tank and the valve 7A leads to an inlet 28 to a liquid cylinder 26 of an isolator EA. The isolator EA may be identical to the isolators 1, 2 and 3 and includes an air cylinder 20 having an air inlet/outlet 22 and an air inlet/outlet 24, a divider 32 mounting the air and liquid cylinders and a piston assembly comprising an air piston 34, a liquid piston 36 and a rod 38 extending through the divider and between the air and liquid pistons. The liquid cylinder has a liquid outlet 30 and a valve JA is operable to supply compressed air through either a speed control 40 to the air inlet/outlet 22 or through a speed control 42 to the air inlet/outlet 24, while venting the other air inlet/outlet, to move the piston assembly between upper and lower positions. The outlet from the liquid cylinder connects through check valves CV8 and CV9, the fiberoptic flow meter FT and the regulator valve L to the spray device SD.

The application system B also differs from the one of FIG. 1 in that the outlet 68 from its reservoir 1B does not connect directly to the inlet to the fiberoptic flow meter FT. Instead, the reservoir outlet connects to inlets to each of a dump diverter valve 6B and a diverter valve 7B. The valve 6B leads to the dump tank and the valve 713 leads to a liquid inlet 28 to a liquid cylinder 26 of an isolator EB. The isolator EB may be identical to the isolators 1, 2 and 3 of FIG. 1 and includes an air cylinder 20 having an air inlet/outlet 22 and an air inlet/outlet 24, a divider 32 mounting the air and liquid cylinders on its opposite sides and a piston assembly comprising an air piston 34 within the air cylinder, a liquid piston 36 within the liquid cylinder and a rod 38 extending through the divider and between the air and liquid pistons. The liquid cylinder has a liquid outlet 30 and a valve JB connects through a speed control 40 to the air inlet/outlet 22 and through a speed control 42 to the air inlet/outer 24. The valve JB is operable to apply compressed air to a selected one of the air inlet/outlets while venting the other in order to move the piston assembly between upper and lower positions. The outlet from the liquid cylinder connects through a check valve CV10, the fiberoptic flow meter FT and the regulator valve L to the spray device SD.

A color changer CCS for nonconductive solventborne paint also is connected to the spray device SD through a check valve CV11, the check valve CV9, the fiberoptic flow meter FT and the regulator valve L. The color changer CCS is operable to deliver at its outlet any one of a number of different colors of solventborne paint, such as color 1 through a valve SA and color 2 through a valve SB, and to supply solvent through a valve SD and compressed air through a valve SC.

A description of the operation of the system of FIG. 2 in loading and delivering paint to the spray device SD will, to avoid confusion with the operation of the system of FIG. 1, be described as beginning with a step 6.

Step 6: Assume that application system A is to deliver a selected color of paint to the spray device SD. To load application system A with the selected color of paint from the color changer CCA, to deliver the paint to the spray device and to maintain a supply of the paint in the reservoir 1A to the extent necessary to perform the particular spraying operation, application system A is operated generally in accordance with steps 1–4 described in connection with the application system of FIG. 1. A difference is that paint exiting the outlet 68 from the reservoir 1A is not connected directly to the fiberoptic flow meter FT. Instead, the paint is delivered from the reservoir outlet through the diverter valve 7A to the liquid inlet 28 to the liquid cylinder 26 of the isolator EA, the dump diverter valve 6A at this time being closed and the valve JA operated so that the piston assembly of the isolator is raised. From the liquid inlet the paint flows through the liquid cylinder to the liquid outlet 30, and from there through the check valves CV8 and CV9, the fiberoptic flow meter FT and the regulator valve L to the spray device SD at a rate determined by a control signal applied to the regulator valve L. Also, at this time the high voltage power supply applies a high voltage to the conductive paint at the inlet to the fiberoptic flow meter FT for connection through the paint to the spray device SD. The piston assembly of the isolator assembly EB was earlier moved to its lower position, causing its liquid piston 36 to scrape the inner walls of its liquid cylinder 26 generally free of paint, so at this time the liquid cylinder is substantially electrically nonconductive between its liquid outlet 30 and its liquid inlet 28 and the isolator assembly EB isolates the high voltage from the application system B.

Continuing with step 6, while the application system A delivers paint to the spray device SD the application system B is flushed clean of the color of paint it previously delivered. Flushing occurs generally in accordance with steps 5A and 5B described in connection with the application system of FIG. 1, except that in flushing application system B the regulator valve L and the dump valve D V are not used. Instead, the diverter valve 7B is dosed and the dump diverter valve 6B is opened, and air and solvent are delivered from the color changer CCB and exit the outlet 68 from the reservoir 1B for flow directly to the dump tank through the dump diverter valve 6B. At the very end of delivery of paint by application system B to the spray device and prior to flushing, the valve JB was operated to move the piston assembly of the isolator EB to its lower position to scrape clean the inner walls of its liquid cylinder 26, so that during flushing the application system B is electrically isolated from the high voltage at the power supply. Once application system B is clean, the valve 6B is dosed and the next selected paint to be delivered by application system B to the spray device SD is loaded into the reservoir 1B according to steps 1–4.

Step 7: Just prior to completion of delivering paint of color 1 from the reservoir 1A of the application system A, the diverter valve 7A is closed and the valve JA is operated to move the piston assembly of the isolator EA to its lower position. This pushes to the spray device SD paint of color 1 remaining in the isolator EA and scrapes paint from the inner walls of its liquid cylinder so that the isolator becomes substantially nonconducting and electrically isolates the high voltage at the power supply from the application system A. Upon completion of spraying paint delivered by the application system A, the power supply is turned off and the dump DV is opened, following which the air valve SC and the solvent valve SD of the color changer CCS are alternately opened to flow alternate bursts of air and solvent from the color changer outlet through the check valves CV11 and CV9, the fiberoptic flow meter FT, the regulator valve L, the spray device SD and the dump valve DV to the dump tank to clean the paint flow path downstream from the isolator EA. Air only is then supplied by the color changer CCS for a time sufficient to dry any solvent remaining in the system, whereupon the dump valve DV is closed.

Step 8: Following cleaning of the paint flow path downstream from the isolators EA and EB of paint previously supplied by the application system A, the application system B is operated in generally the same manner as was the application system of FIG. 1 according to steps 1–4, to deliver to the spray device SD the next color of paint to be sprayed, except that paint leaving the outlet 68 from the reservoir 1B does not flow directly to the fiberoptic flow meter FT. Instead, the valve JB is operated to raise the piston assembly of the isolator EB to establish a flow path between the isolator inlet 28 and outlet 30, and the dump diverter valve 6B is closed and the diverter valve 713 is opened, so that paint leaving the reservoir 1B first flows through the liquid cylinder 26 of the isolator EB, the check valve CV10 and then to and through the fiberoptic flow meter FT and the regulator valve L to the spray device SD for being emitted in an atomized spray. While the application system B delivers paint to the spray device and the high voltage power supply is energized to electrostatically charge the spray, application system A is flushed in generally the same manner as the application system of FIG. 1 is flushed according to steps 5A and 5B, during which time the piston assembly of the isolator EA remains lowered so that the isolator provides electrical isolation between the high voltage and the application system A. However, unlike flushing the application system of FIG. 1, solvent and air flowed through the application system A are not directed through the regulator valve L, the spray device and the dump valve DV to the dump tank. Instead, the diverter valve 7A is closed and the dump diverter valve 6A is opened, so that air and solvent introduced by the color changer CCA, after flowing through the isolators 1, 2 and 3 and the reservoir 1A, are directed through the dump diverter valve 6A to the dump tank. After the application system A is clean, the valve 6A is closed and the application system A is operated in accordance with steps 1–4 to load the reservoir 1A with the next color of paint to be sprayed.

The system of FIG. 2 advantageously provides shortened times between color changes, since while one application system delivers paint to the spray device the other is cleaned and filled with the next color of paint to be sprayed, so that upon completion of spraying paint of one color, the next color of paint is ready to be delivered to the spray device. Electrical isolation is always maintained between the high voltage and the grounded parts of the application systems by virtue of the arrangement and mode of operation of the isolators 1, 2 and 3 of each application system and of the separate isolators EA and EB. The color changer CCS provides any necessary delivery of solventborne paint and accommodates flushing the downstream part of the system between color changes.

Figure 3:
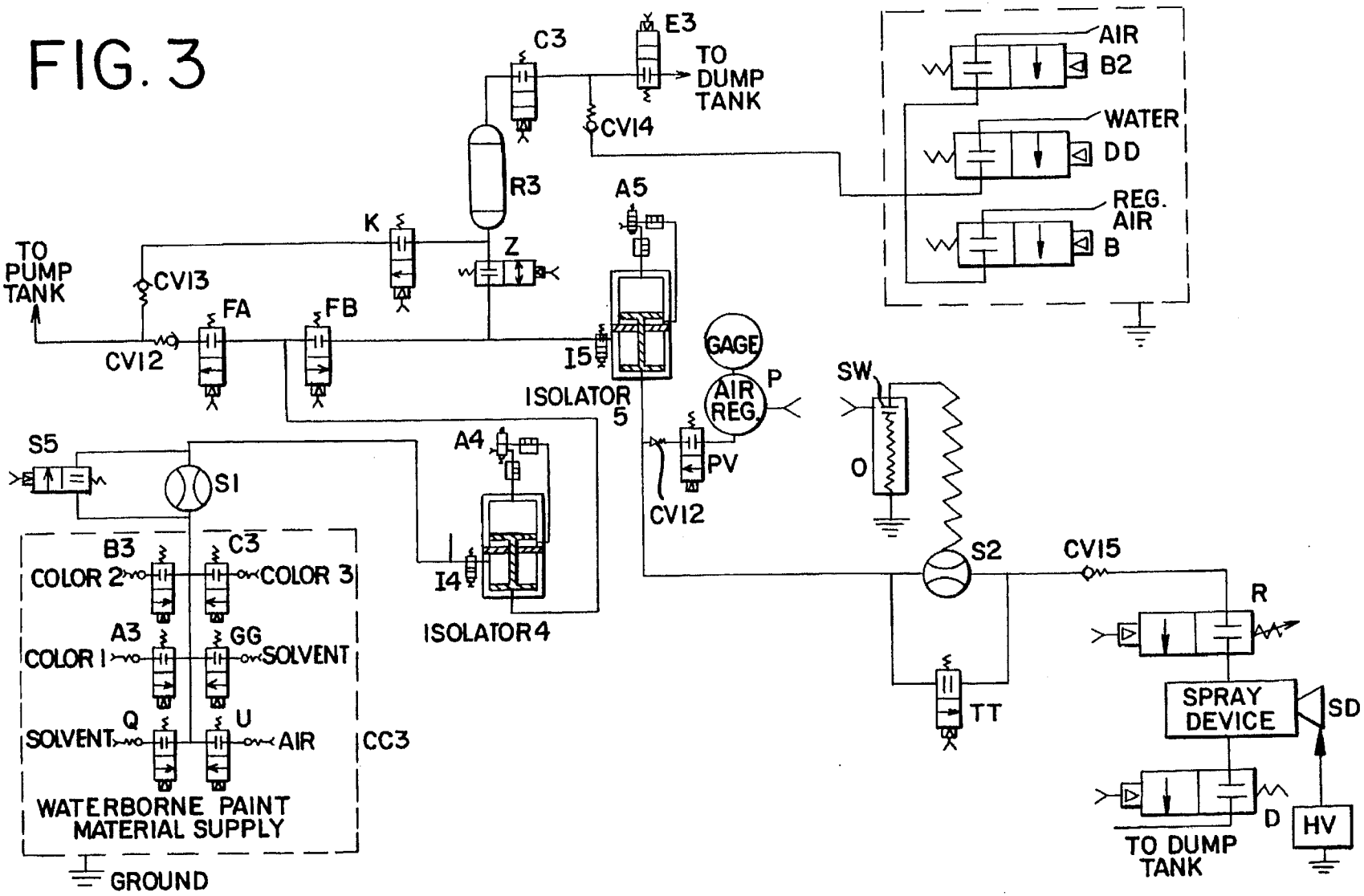
FIG. 3 is a schematic representation of yet another embodiment of system for delivering coating liquid to an electrostatic spray coating device.

FIG. 3 shows another embodiment of system for electrostatic application of conductive coating liquid, that includes a spray device SD and a grounded color changer assembly CC3 that is operable to selectively supply any one of a number of different colors of paint to the spray device. The color changer assembly delivers paint to the spray device through an isolation system or voltage block that is constructed and operated according to the teachings of the invention. Except for the two isolators 4 and 5 and their associated valves I4, A4, I5 and A5, and for an air regulator P and its associated valve PV and check valve CV12, the FIG. 3 system is generally the same as the one illustrated and described in U.S. Pat. No. 5,288,525, issued Feb. 22, 1994 to the present inventor and assigned to the assignee of the present invention, the entirety of the teachings of which are specifically incorporated herein by reference.

The color changer assembly is conventional and includes the grounded color changer CC3 which has a plurality of inlets connected to grounded supplies of different colors of conductive paints or coating materials, of which colors 1, 2 and 3 represent three of what may be a large number of different colors. The color changer operates in a known manner to supply at its outlet a selected one of the colors of paint through respective valves A3, B3 and C3, and has a valved water inlet Q, a valved air inlet U and a valved chemical solvent inlet GG. An outlet from the color changer connects through a flow meter S1, an inlet valve I4 to the isolator 4 and the isolator to a pair of directional valves FA and FB. A bypass valve SS is operable to selectively direct the outflow from the color changer either through the flow meter or to establish a bypass path around the flow meter. The color changer is operable to supply selected colors of paint through the isolation system to the electrostatic spray apparatus, which includes the spray device SD, a regulator valve R for controlling the pressure of paint at an inlet to the spray device in accordance with the value of a pneumatic signal applied to a control inlet to the regulator valve, and a gun dump valve D that is operable to connect an outlet from the gun to a dump tank.

The isolation system prevents the high voltage at the spray device from ever being coupled through a conductive column of paint to any part of the apparatus that is then grounded. Considering the structure of the isolation system in greater detail, it includes a plurality of pneumatically controlled valves and fluid lines of electrically insulating material. It also includes the isolators 4 and 5, which may be identical to the isolators illustrated and described in connection with FIG. 1. As mentioned, the outlet from the color changer CC3 couples through the flow meter S1, its bypass valve SS, the inlet valve I4 and the isolator 4 to inlets to the directional valves FA and FB. An outlet from the valve FA connects through a check valve CV12 to a grounded dump tank. An outlet from the directional valve FB connects through the inlet valve 15, the isolator 5, a flow meter S2 and its bypass valve TT, a check valve CV15 and the regulator valve R to the spray device SD. The bypass valve TT is operable to establish a flow path around the flow meter S2.

The outlet from the directional valve FB also connects through a reservoir bottom paint valve Z to a lower inlet/outlet of a reservoir R3. Also connected to the reservoir lower inlet/outlet is a reservoir bottom purge valve K leading through a check valve CV13 to the dump tank. Grounded supplies of high pressure air, water and regulated air at a pressure lower than the high pressure air are selectively connectable by respective valves B2, DD and B through a check valve CV14 to a reservoir top vent/purge valve C3 that connects to an upper inlet/outlet of the reservoir and to a reservoir top purge valve E3 leading to the dump tank. The outlet from the air regulator P connects through the valve PV to the paint flow path or fluid line close or adjacent to the outlet from the liquid cylinder of the isolator 5. The ground leg O connects to the flow meter S2 and is selectively operable to close and open a switch SW to ground and unground conductive liquid in the path through the flow meter and thereby conductive liquid to which the high voltage can be applied. The various valves may be operated either manually or by automatic control.

The isolation system is operated in a manner to deliver conductive paint from the color changer CC3 to the spray device SD while maintaining electrical isolation between the high voltage at the spray device and grounded parts of the application system. Starting with all of the valves closed and with a clean and empty system, and with the valves A4 and A5 operated to raise the piston assemblies of the isolators 4 and 5, a first selected color of paint, such as color 1, is loaded into the fluid path between the color changer outlet and the spray device. This is accomplished by operating the color changer valve A3 to deliver paint of color 1 from the color changer outlet while simultaneously opening the valves I4, FB, I5, R and D. The volumetric capacity of the paint flow path between the color changer and spray device is known and the flow meter S1 measures the volume flow of paint delivered from the color changer. When the measured volume flow equals the volumetric capacity of the paint flow path the valve D is closed and the valves Z, C3 and E3 are opened, so that paint from the color changer then flows through the valve Z into the reservoir R3. The total volume flow of paint from the color changer is measured by the flow meter S1 and is limited to the mount required for a spraying operation. When that mount is measured the color changer valve A3 is closed.

At this point, a column of paint of known volume extends between the color changer outlet and the valve Z and comprises part of the total volume of paint to be sprayed. To utilize this paint, the color changer valve U is opened for a time sufficient to introduce into the color changer a volume of air that pushes the column of paint through the valve Z, and into the reservoir R3.

Next, the reservoir R3 and spray device SD are electrically isolated from the grounded color changer assembly CC3 and dump tank. This is accomplished by closing the valve I4 and by operating the valve A4 to drive the piston assembly of the isolator 4 downwardly, so that the liquid piston of the piston assembly scrapes the walls of the liquid cylinder clean of paint and the isolator becomes electrically insulating between the color changer assembly and the valves FA and FB. Simultaneously, at least a portion of the path between the top of the reservoir and the dump tank is cleaned and dried to electrically isolate the reservoir and the spray device from the grounded dump tank. This is accomplished by closing the valve C3 and opening the valve E3 while alternately opening and closing the valves DD and B2 to alternately flow water and high pressure air through the part of the fluid path that includes the valve E3. To finish isolating the reservoir and the spray device from the dump tank, just the valve B2 is opened to flow high pressure air through the path for a time sufficient to dry the path.

Upon completion of electrical isolation of the reservoir R3 and the spray device SD from the grounded dump tank and color changer assembly CC3, the system is ready to spray paint electrostatically. This is accomplished by closing the valve E3 and opening the valves B2, C3 and Z to pressurize the top of the reservoir and flow paint from the reservoir through the isolator 5, the flow meter S2 and the regulator valve R to the spray device. Also, the ground leg O is actuated to remove ground from the conductive paint in the flow meter S2 and a high voltage is applied to the spray device. While spraying, the flow meter S2 monitors the flow rate of paint to the spray device and the regulator valve R is controlled to maintain a selected flow rate. The flow meter S2 also measures the amount of paint delivered to the spray device, and since the total volume of paint loaded into the system is known, the measurement can be used to terminate spraying when substantially the entirety of the paint loaded into the system has been delivered to the spray device. This minimizes paint wastage and facilitates cleaning the system incident to color changes.

For a repeat color situation where the same color of paint is to be sprayed in two or more successive spraying operations, it is not necessary to fully clean the system between spraying operations. In this case, when the reservoir R3 is nearly empty at the end of one spraying operation, as determined by a comparison of the amounts of paint measured by the flow meters S1 and S2, spraying is stopped, the high voltage is removed from the spray device SD, the ground leg 0 is operated to apply ground to the flow meter S2, the valve A4 is operated to raise the piston assembly of the isolator 4, the valves I4 and FB are opened and the valve I5 is closed, permitting the reservoir to be refilled by the color changer CC3 with the same color of paint for the next spraying operation. Following refilling of the reservoir it and the spray device are again isolated from the grounded color changer and dump tank in the manner previously described, the ground leg is operated to remove ground from the flow meter S2, the reservoir is pressurized, the valve I5 is opened, the high voltage is reapplied and spraying continues.

If a different color of paint is to be sprayed next, the system is first cleaned of paint of color 1 before the new color of paint is loaded into it. To shorten the time between spraying operations when a color change is to be made, the flow meter S2 measures the volume of paint of color 1 flowed to the spray device SD from the reservoir R3 and, when it is determined by a comparison to the amount of paint measured by the flow meter S1 that the reservoir is substantially empty, the valves I5 and Z are closed. The valve A5 is then operated to drive the piston assembly of the isolator 5 to its lower position to move paint in the isolator to the spray device and also to electrically isolate the high voltage from the system upstream from the isolator. Upon completion of movement of the piston assembly of the isolator 5 to its lower position, the valve PV is opened to introduce air at a regulated pressure through the check valve CV12 into the fluid line very close or adjacent to the outlet from the isolator to push paint of color 1 that remains in the fluid line downstream from the isolator to the spray device to be sprayed.

By electrically isolating the portion of the system upstream from the isolator 5, the upstream portion can be cleaned while paint of color 1 continues to be sprayed, which advantageously shortens the time between color changes. To clean the path from the color changer CC3 to the valve FA, the valve A4 is operated to move the piston assembly of the isolator 4 to its upper position, the valves I4 and FA are opened, the valve FB is closed and the color changer valves U and GG are alternately opened and closed to alternately flow air and solvent from the color changer to and through the flow meter S1, the valve I4, the isolator 4, the valve FA and the check valve CV12 to the dump tank to clean the fluid path between the color changer and the valve FA. During such cleaning, when air is delivered by the color changer the bypass valve SS is opened to bypass and prevent overdriving the flow meter S1. To finish cleaning the fluid path from the color changer to the valve FA, the valve GG is closed and the valve U is opened to flow air through the path for a time sufficient to dry the path.

The reservoir R3 is cleaned simultaneously with cleaning the fluid path from the color changer to the valve FA and while spraying continues, by opening the valves C3, B and K to introduce air into the reservoir to push out paint remaining in it, and by briefly opening the valve DD to flow water into the top of and through the reservoir and through the valve K to the dump tank. The valve B is then closed and the valves DD, B2, C3 and K are opened to flow water and high pressure air through the reservoir to the dump tank, following which the valve B2 is closed and the valves DD, C3, B and K are opened to flow water and air at a lower pressure through the reservoir to the dump tank. The valve B is then dosed while the valves DD, C3 and K remain open to flow water only through the reservoir, following which the valve DD is closed and the valve B2 is opened to flow high pressure air through the reservoir for a time sufficient to dry the reservoir and the fluid path from the reservoir to the dump tank. The reservoir is then clean and ready to be loaded with the next color of paint to be sprayed.

It normally takes longer to clean the reservoir R3 than to dean the fluid path between the color changer CC3 and the valve FA or to deliver paint remaining in the fluid line downstream from the isolator 5 to the spray device SD. Consequently, upon completion of cleaning the fluid path from the color changer to the valve FA and of delivery of paint to the spray device, the fluid path from the color changer to the spray device is cleaned while cleaning of the reservoir continues. To clean such fluid path, the valves A4 and A5 are operated to raise the piston assemblies of the isolators 4 and 5 and the valves I4, FB, I5, R and D are opened. The color changer water valve Q is then opened so that water flows from the color changer through the fluid path including the flow meters S1 and S2, the isolators 4 and 5 and the valves I4, FB, I5 and R to and through the spray device and the dump valve D to the dump tank, following which the color changer water valve Q is closed and the color changer air valve U is briefly opened to flow air through the path. The color changer solvent valve GG is then opened and the spray gun is triggered on to emit solvent from and thoroughly clean the spray device. The color changer valve GG is then closed and the air valve U is briefly opened to flow air through the fluid path to and through the spray device. The air valve U is then closed and the solvent valve GG is again opened to flow solvent through the fluid path while the spray device is again triggered on, during which time the bypass valve TT of the flow meter S2 is briefly opened to flow solvent through it. The color changer solvent valve GG is then closed and the air valve U is opened to flow air through the fluid path to remove excess solvent from the path, during which time the bypass valve TT is briefly opened to dry the valve and the spray device is briefly triggered on to remove residual solvent from its interior. With the system cleaned, it is ready to be filled with and to deliver to the spray device the next color of paint to be sprayed.

The invention provides various embodiments of isolation systems or voltage blocks for electrically isolating a high voltage at an electrostatic spray device from grounded parts of the application system, for example from a grounded primary supply of paint from which conductive paint is delivered to the spray device. In each embodiment the isolating means includes an isolator that is mechanically operable to either accommodate a flow of conductive paint between an inlet to and an outlet from the isolator or to interrupt the flow while simultaneously providing electrical isolation between the inlet and the outlet.

While embodiments of the invention have been described in detail, various modifications and other embodiments thereof may be devised by one skilled in the art without departing from the spirit and scope of the invention, as defined in the appended claims.

What is claimed:

1. A system for electrostatic application of relatively conductive coating liquid, comprising:

an electrostatic spray device coupled to an interruptable high voltage supply;

reservoir means having an inlet and an outlet coupled to an inlet to said spray device to supply said spray device with coating liquid;

grounded coating liquid supply means;

means for transferring coating liquid from said coating liquid supply means to said reservoir means while maintaining electrical isolation therebetween, said transferring means comprising at least three isolator means, each said isolator means including passage means of electrically insulating material extending between an inlet to an outlet from said passage means, and means for mechanically displacing, without the Use of solvent for the coating liquid, from said passage means and passage means surface and through said passage means outlet coating liquid introduced to said passage means through said passage means inlet, so that each said isolator means is electrically insulating between its inlet and outlet upon mechanical displacement of coating liquid from its passage means and passage means surface, said at least three isolator means being connected with their passage means in series between said coating liquid supply means and said reservoir means to define a flow path for transfer of coating liquid from said coating liquid supply means to said reservoir means; and means for operating said isolator means mechanical displacing means so that coating liquid is always mechanically displaced from the passage means and passage means surface of at least one of said isolator means at all times when the high voltage is present, whereby electrical isolation is always maintained between said reservoir means and said grounded coating liquid supply means and thereby between the high voltage and said grounded coating liquid supply means.

2. A system as in claim 1, wherein:

said coating liquid supply means is coupled to an inlet to a first one of said isolator means, said outlet from said first isolator means is coupled to an inlet to a second one of said isolator means, said outlet from said second isolator means is coupled to an inlet to a third one of said isolator means, said outlet from said third isolator means is coupled to said reservoir means, and said operating means operates said means for mechanically displacing to sequentially mechanically displace coating liquid introduced to said first isolator means passage means from said first isolator means passage means and passage means surface to said second isolator means passage means, then from said second isolator means passage means and passage means surface to said third isolator means passage means, then from said third isolator means passage means and passage means surface to said reservoir means to maintain coating liquid in said reservoir means for supply to said spray device.

3. A system as in claim 2, including means for sensing the level of coating liquid in said reservoir means and for controlling said operating means to transfer coating liquid from said coating liquid supply means to said reservoir means until the level of coating liquid in said reservoir means reaches an upper level, to then interrupt transfer of coating liquid until sufficient coating liquid is supplied from said reservoir means to said spray device to cause the level of coating liquid in said reservoir means to fall to a lower level, and to then resume transfer of coating liquid to said reservoir means.

4. A system as in claim 2, wherein said coating liquid supply means comprises:

a color changer for supplying different colors of coating liquid, solvent for the coating liquid and compressed air, and means for operating said color changer means to flow solvent and air through said three isolator means, said reservoir means and said spray device to clean the same of one color of coating liquid in preparation for supplying to said spray device another color of coating liquid.

5. A system as in claim 2, including:

first means for measuring the amount of coating liquid delivered from said coating liquid supply means to said first isolator means;

second means for measuring the amount of coating liquid supplied by said reservoir means to said spray device;

means for interrupting delivery of coating liquid from said coating liquid supply means when said first measuring means measures a first predetermined amount of coating liquid; and means for interrupting delivery of coating liquid from said reservoir means to said spray device when said second measuring means measures a second and lesser predetermined amount of coating liquid.

6. A system as in claim 1, wherein said means for mechanically displacing comprises pneumatically operated mechanical displacing means.

7. A system as in claim 1 wherein:

each said isolator means passage means comprises a cylinder having said inlet toward one end thereof and said outlet toward an opposite end, and said means for mechanically displacing comprises a piston movable in said cylinder between said inlet and outlet to displace through said outlet coating liquid introduced to said cylinder through said inlet and to scrape coating liquid from the inside surface of said cylinder, so that upon movement of said piston toward said outlet said cylinder becomes electrically insulating between its inlet and outlet without the use of solvent for the coating liquid.

8. A system as in claim 1, including means for grounding the contents of said reservoir means when the high voltage is not present.

9. Apparatus for electrostatic application of relatively conductive coating liquid, comprising:

first and second application systems, each said application system including a grounded coating liquid supply means, reservoir means, and means for transferring coating liquid from said coating liquid supply means to said reservoir means while electrostatic application of coating liquid is occurring and while maintaining electrical isolation between said reservoir means and said coating liquid supply means;

an electrostatic spray device coupled to an interruptable high voltage supply;

first application system isolator means coupled between said first application system reservoir means and said spray device and operable between a first state establishing a coating liquid flow path from said reservoir means to said spray device and a second state interrupting said flow path and electrically isolating said reservoir means from a high voltage at said spray device; and second application system isolator means coupled between said second application system reservoir means and said spray device and operable between a first state establishing a coating liquid flow path from said reservoir means to said spray device and a second state interrupting said flow path and electrically isolating said reservoir means from a high voltage at said spray device.

10. Apparatus as in claim 9, including means for connecting said spray device to ground potential when said high voltage is interrupted.

11. Apparatus for electrostatic application of relatively conductive coating liquid, comprising:

first and second application systems, which said application system including a grounded coating liquid supply means, reservoir means, and means for transferring coating liquid from said coating liquid supply means to said reservoir means while electrostatic application of coating liquid is occurring and while maintaining electrical isolation between said reservoir means and said coating liquid supply means;

an electrostatic spray device coupled to an interruptable high voltage supply;

first application system isolator means coupled between said first application system reservoir means and said spray device and operable between a first state establishing a coating liquid flow path from said reservoir means to said spray device and a second state interrupting said flow path and electrically isolating said reservoir means from a high voltage at said spray device; and second application system isolator means coupled between said second application system reservoir means and said spray device and operable between a first state establishing a coating liquid flow path from said reservoir means to said spray device and a second state interrupting said flow path and electrically isolating said reservoir means from a high voltage at said spray device, including means for operating said apparatus so that said first and second application systems provide coating liquid to said spray device one at a time, and so that when one application system is providing coating liquid its means for transferring is transferring coating liquid from its coating liquid supply means to its reservoir means while maintaining electrical isolation therebetween and its application system isolator means is in said first state to establish a flow path for coating liquid from its reservoir means to said spray device, while at the same time said application system isolator means of the other application system is in said second state to electrically isolate said other application system reservoir means from a high voltage at said spray device.

12. Apparatus as in claim 11, wherein each said coating liquid supply means comprises a grounded color changer for delivery of coating liquid, solvent for the coating liquid, and air, and including separate solvent and air supply means connected to selectively introduce solvent and air to a coating liquid flow path extending between said first and second application system isolator means and said spray device.

13. Apparatus for electrostatic application of relatively conductive coating liquid, comprising:

first and second application systems, each said application system including a grounded coating liquid supply means, reservoir means, and means for transferring coating liquid from said coating liquid supply means to said reservoir means while electrostatic application of coating liquid is occurring and while maintaining electrical isolation between said reservoir means and said coating liquid supply means;

an electrostatic spray device coupled to an interruptable high voltage supply;

first application system isolator means coupled between said first application system reservoir means and said spray device and operable between a first state establishing a coating liquid flow path from said reservoir means to said spray device and a second state interrupting said flow path and electrically isolating said reservoir means from a high voltage at said spray device; and second application system isolator means coupled between said second application system reservoir means and said spray device and operable between a first state establishing a coating liquid flow path from said reservoir means to said spray device and a second state interrupting said flow path and electrically isolating said reservoir means from a high voltage at said spray device, wherein said transferring means of each said application system comprises:

a plurality of isolator means, each said isolator means having passage means of electrically insulating material extending between an inlet to and an outlet from said passage means and means for mechanically displacing, without the use of solvent for the coating liquid, from said passage means and passage means surface and through said passage means outlet coating liquid introduced to said passage means through said passage means inlet, so that each said isolator means is electrically insulating between its inlet and outlet upon mechanical displacement of coating liquid from its passage means and passage means surface, said plurality of isolator means of each said application system being connected with their passage means in series between said coating liquid supply means and said reservoir means of their associated application system, and including means for operating said mechanical displacing means of said plurality of isolator means of each said application system, such that for each application system coating liquid is always mechanically displaced from the passage means and passage means surface of at least one of its plurality of isolator means at all times when the high voltage is present and said application system is providing coating liquid to said spray device, whereby electrical isolation is always maintained between said reservoir means and said grounded coating liquid supply means of such application system.

14. Apparatus as in claim 13, wherein each said plurality of isolator means comprises at least three isolator means.

15. Apparatus as in claim 13, wherein for each said application system said plurality of isolator means comprises three isolator means and;

said coating liquid supply means is coupled to said inlet to a first one of said isolator means, said outlet from said first isolator means is coupled to said inlet to a second one of said isolator means, said outlet from said second isolator means is coupled to said inlet to a third one of said isolator means, said outlet from said third isolator means is coupled to said reservoir means, and said operating means operates said mechanical displacing means to sequentially mechanically displace coating liquid introduced to said first isolator means passage means from said first isolator means passage means and passage means surface to said second isolator means passage means, then from said second isolator means passage means and passage means surface to said third isolator means passage means, then from said third isolator means passage means and passage means surface to said reservoir means to maintain coating liquid in said reservoir means for supply to said spray device.

16. Apparatus as in claim 15, wherein each said application system further includes:

means for sensing the level of coating liquid in its reservoir means and for controlling said displacing means to transfer coating liquid to said reservoir means until the coating liquid is at an upper level in said reservoir means, to then interrupt transfer of coating liquid until sufficient coating liquid is supplied from said reservoir means to said spray device to cause the coating liquid to fall to a lower level in said reservoir means, and to then resume transfer of coating liquid to said reservoir means.

17. Apparatus as in claim 13, wherein said coating liquid supply means of each said application system comprises:

a color changer for supplying different colors of coating liquid, solvent for the coating liquid, and compressed air, and means for operating said color changer to flow solvent and air through said plurality of isolator means and said reservoir means to clean the same of coating liquid of one color in preparation for introducing into the same coating liquid of another color.

18. A system for electrostatic application of relatively conductive coating liquid, comprising:

an electrostatic sprayer coupled to an interruptable high voltage supply;

grounded coating liquid supply means;

reservoir means;

first isolator means having passage means coupled with its passage means in series with a first coating liquid flow path between said coating liquid supply means and said reservoir means and operable between a first state establishing a path through said passage means and a second state interrupting the path through said passage means and providing electrical isolation in said first flow path, without use of solvent for the coating liquid, between said coating liquid supply means and said reservoir means; and second isolator means having passage means coupled with its passage means in series with a second coating liquid flow path between said reservoir means and said spray device and operable between a first state establishing a path through its passage means and a second state interrupting the path through its passage means and providing electrical isolation in said second flow path, without use of solvent for the coating liquid, between said reservoir means and said spray device.

19. A system as in claim 18, wherein said first and second isolator means each comprises:

a body of electrically insulating material through which said passage means extends between an inlet to and an outlet from said passage means, and means for mechanically displacing without use of solvent for the coating liquid, from said passage means and passage means surface and through said passage means outlet coating liquid introduced to said passage means through said passage means inlet, said isolator means being in said second state and being electrically insulating between its inlet and outlet when coating liquid is displaced from said passage means.

20. A system as in claim 18, wherein said first and second flow paths and said first and second isolator means are in series between said coating liquid supply means and said spray device and said reservoir means is coupled to at least one of said first and second flow paths intermediate said first and second isolator means.

21. A system as in claim 20, including operating means for operating said system to:

place said first and second isolator means in their first states and flow coating liquid from said coating liquid supply means and through said first and second flow paths and said first and second isolator means passage means to said spray device and to and into said reservoir means;

then place said first isolator means in its second state to electrically isolate said grounded coating liquid supply means from said reservoir means and said spray device; and then deliver coating liquid from said reservoir means through said second flow path and said second isolator means passage means to said spray device while operating said spray device and applying a high voltage thereto to electrostatically spray the coating liquid.

22. A system as in claim 21, wherein said operating means, upon said reservoir means delivering substantially all of the coating liquid in it, further operates said system to:

interrupt the high voltage and delivery of coating liquid from said reservoir means;

then place said first isolator means in its first state and flow coating liquid from said coating liquid supply means and through said first flow path and said first isolator means into said reservoir means to refill said reservoir means;

then place side first isolator means in its second state to again electrically isolate said coating liquid supply means from said reservoir means and said spray device; and then deliver coating liquid from said refilled reservoir means through said second flow path and said second isolator means to said spray device while operating said spray device and applying the high voltage thereto to electrostatically spray the coating liquid.

23. A system as in claim 20, wherein said coating liquid supply means comprises a color changer for delivering selected ones of different colors of coating liquid, and further including supplies of both solvent for the coating liquid and compressed air;

and operating means for operating said system to:

place said first and second isolator means in their first states and flow a selected color of coating liquid from said color changer and through said first and second flow paths and said first and second isolator means passage means to said spray device and to and into said reservoir means;

then place said first isolator means in its second state to electrically isolate said grounded color changer from said reservoir means and said spray device;

then deliver coating liquid from said reservoir means and through said second flow path and said second isolator means passage means to said spray device while operating said spray device and applying a high voltage thereto to electrostatically spray coating liquid;

then place said second isolator means in its second state upon substantial depletion of the selected color of coating liquid from said reservoir means to electrically isolate said spray device from said reservoir means and said color changer;

then continue to deliver the selected color of coating liquid in said second flow path, downstream from said second isolator means, to said spray device for being electrostatically sprayed while placing said first isolator means in its first state and introducing air and solvent into said first isolator means, said first flow path and said reservoir means to clean the same of the selected color of coating liquid;

then, upon completion of spraying the selected color of coating liquid, interrupt the high voltage, place said second isolator means in its second state, and introduce air and solvent into said second isolator means, said second flow path and said spray device to clean the same of the selected color of paint; and repeat the above operations to introduce into said system and electrostatically spray the next selected color of coating liquid.

* * * * *

UNITED STATES PATENT AND TRADEMARK OFFICE

CERTIFICATE OF CORRECTION

PATENT NO. : 5,647,542

DATED : July 15, 1997

INVENTOR(S) : Michael J. Diana

It is certified that error appears in the above-identified patent and that said Letters Patent is hereby corrected as shown below:

Column 1, Line 6, Insert --to-- after "relates"
Column 1, Line 6, Delete "system" and insert therefor --systems--
Column 1, Line 15, Delete "colon" and insert therefor --colors--
Column 1, Line 44, Delete "mount" and insert therefor --amount--
Column 1, Line 48, Delete "mating" and insert therefor --coating--
Column 4, Line 11, Delete "mating" and insert therefor --coating--
Column 5, Line 37, Delete "mating" and insert therefor --coating--
Column 6, Line 13, Delete "dram" and insert therefor --drawn--
Column 6, Line 37, Delete "It" and insert therefor --H--
Column 7, Line 2, Delete "mount" and insert therefor --amount--
Column 7, Line 4, Delete "I" and insert therefor --J--
Column 8, Line 52, Delete "mount" and insert therefor --amount--
Column 10, Line 32, Delete "713" and insert therefor --7B--
Column 11, Line 35, Delete "dosed" and insert therefor --closed--
Column 11, Line 46, Delete "dosed" and insert therefor --closed--
Column 12, Line 15, Delete "713" and insert therefor --7B--
Column 16, Line 4, Delete "dosed" and insert therefor --closed--
Column 16, Line 12, Delete "dean" and insert therefor --cleaned--
Column 19, Line 12, Delete "which" and insert therefor --each--

UNITED STATES PATENT AND TRADEMARK OFFICE

CERTIFICATE OF CORRECTION

PATENT NO. : 5,647,542

DATED : July 15, 1997

INVENTOR(S) : Michael J. Diana

It is certified that error appears in the above-indentified patent and that said Letters Patent is hereby corrected as shown below:

Column 22, Line 43, Delete "side" and insert therefor --said--

Signed and Sealed this

Eleventh Day of August 1998

*Attest:*

*Attesting Officer*

BRUCE LEHMAN

*Commissioner of Patents and Trademarks*